US010927688B2

(12) United States Patent
Azcarate Castrellon et al.

(10) Patent No.: US 10,927,688 B2
(45) Date of Patent: Feb. 23, 2021

(54) STEAM TURBINE NOZZLE SEGMENT FOR PARTIAL ARC APPLICATION, RELATED ASSEMBLY AND STEAM TURBINE

(71) Applicant: General Electric Company, Schenectady, NY (US)

(72) Inventors: Martha Alejandra Azcarate Castrellon, Queretaro (MX); Cesar Corona Bravo, Queretaro (MX); Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 705 days.

(21) Appl. No.: 14/753,588

(22) Filed: Jun. 29, 2015

(65) Prior Publication Data

US 2016/0376898 A1 Dec. 29, 2016

(51) Int. Cl.

| | |
|---|---|
| ***F01D 9/04*** | (2006.01) |
| ***F01D 5/02*** | (2006.01) |
| ***F01D 25/24*** | (2006.01) |

(52) U.S. Cl.

CPC ..... *F01D 9/041* (2013.01); *F01D 5/02* (2013.01); *F01D 9/047* (2013.01); *F01D 25/24* (2013.01); *F05D 2220/31* (2013.01); *F05D 2240/128* (2013.01)

(58) Field of Classification Search

CPC . F01D 9/041; F01D 9/047; F01D 5/02; F01D 25/24

See application file for complete search history.

(56) References Cited

U.S. PATENT DOCUMENTS 2,013,512 A * 9/1935 Birmann ..... F01D 9/047 415/173.7
2,197,521 A * 4/1940 Egli ..... F01D 9/047 415/194
4,616,975 A 10/1986 Duncan
5,586,864 A 12/1996 Knorowski et al.
(Continued)

FOREIGN PATENT DOCUMENTS

CA 2138462 A1 6/1995
EP 1744018 A1 1/2007
(Continued)

OTHER PUBLICATIONS

European Search Report issued in connection with corresponding EP Application No. 16175992.3 dated Oct. 27, 2016.

*Primary Examiner* — David E Sosnowski
*Assistant Examiner* — Danielle M. Christensen
(74) *Attorney, Agent, or Firm* — James Pemrick; Hoffman Warnick LLC

(57) ABSTRACT

A steam turbine diaphragm nozzle segment, related assembly and steam turbine. Various embodiments include a steam turbine diaphragm nozzle segment having: a pair of opposing sidewalls; an airfoil extending between the pair of opposing sidewalls and integral with each of the pair of sidewalls, the airfoil having a single contact surface for directing a flow of working fluid through a flow channel; and a fill region integral with the airfoil and the pair of opposing sides, the fill region extending between the pair of opposing sides along an entirety of a length of the airfoil, the fill region for completely obstructing the flow of working fluid.

15 Claims, 7 Drawing Sheets

(56) References Cited

U.S. PATENT DOCUMENTS

| | | | | |
|---|---|---|---|---|
| 5,743,711 | A * | 4/1998 | Fournier | F01D 5/3015 415/209.2 |
| 5,788,456 | A | 8/1998 | Maier | |
| 6,321,448 | B1 | 11/2001 | Makino et al. | |
| 7,179,052 | B2 * | 2/2007 | Sasaki | F01D 9/042 29/889.22 |
| 7,470,109 | B2 | 12/2008 | Tomko et al. | |
| 8,070,429 | B2 | 12/2011 | Burdgick et al. | |
| 8,562,292 | B2 | 10/2013 | Burdgick et al. | |
| 8,690,533 | B2 | 4/2014 | Burdgick et al. | |
| 2007/0014670 | A1 | 1/2007 | Maeno | |
| 2011/0070064 | A1 * | 3/2011 | Glynn | F01D 5/14 415/1 |
| 2011/0200430 | A1 | 8/2011 | Burdgick et al. | |
| 2012/0087788 | A1 * | 4/2012 | Anderson | F01D 9/065 415/210.1 |
| 2012/0128472 | A1 | 5/2012 | Singh et al. | |
| 2013/0011265 | A1 * | 1/2013 | Miller | F01D 11/008 416/191 |

FOREIGN PATENT DOCUMENTS

| | | | | |
|---|---|---|---|---|
| EP | 1746251 | A1 | 1/2007 | |
| EP | 1408198 | B1 | 3/2013 | |
| FR | 337187 | A * | 3/1904 | F01D 9/047 |
| GB | 394601 | A | 6/1933 | |
| WO | 9837313 | | 8/1998 | |
| WO | 03008765 | A1 | 1/2003 | |

* cited by examiner

STEAM TURBINE NOZZLE SEGMENT FOR PARTIAL ARC APPLICATION, RELATED ASSEMBLY AND STEAM TURBINE

BACKGROUND OF THE INVENTION

The subject matter disclosed herein relates to steam turbines. Specifically, the subject matter disclosed herein relates to nozzle segments in steam turbines.

Steam turbines include static nozzle assemblies that direct flow of a working fluid into turbine buckets connected to a rotating rotor. The nozzle construction (including a plurality of nozzles, or "airfoils") is sometimes referred to as a "diaphragm" or "nozzle assembly stage." Steam turbine diaphragms include two halves, which are assembled around the rotor, creating horizontal joints between these two halves. Each turbine diaphragm stage is vertically supported by support bars, support lugs or support screws on each side of the diaphragm at the respective horizontal joints. The horizontal joints of the diaphragm also correspond to horizontal joints of the turbine casing, which surrounds the steam turbine diaphragm.

BRIEF DESCRIPTION OF THE INVENTION

A steam turbine diaphragm nozzle segment, related assembly and steam turbine are disclosed. Various embodiments include a steam turbine diaphragm nozzle segment having: a pair of opposing sidewalls; an airfoil extending between the pair of opposing sidewalls and integral with each of the pair of sidewalls, the airfoil having a single contact surface for directing a flow of working fluid through a flow channel; and a fill region integral with the airfoil and the pair of opposing sides, the fill region extending between the pair of opposing sides along an entirety of a length of the airfoil, the fill region for completely obstructing the flow of working fluid.

A first aspect of the disclosure includes: a steam turbine diaphragm nozzle segment having: a pair of opposing sidewalls; an airfoil extending between the pair of opposing sidewalls and integral with each of the pair of sidewalls, the airfoil having a single contact surface for directing a flow of working fluid through a flow channel; and a fill region integral with the airfoil and the pair of opposing sides, the fill region extending between the pair of opposing sides along an entirety of a length of the airfoil, the fill region for completely obstructing the flow of working fluid.

A second aspect of the disclosure includes a steam turbine diaphragm segment having: an outer ring; an inner ring within the outer ring; at least one diaphragm nozzle segment coupled to the inner ring and the outer ring, the at least one diaphragm nozzle segment having an airfoil and integral sidewalls for directing a flow of a working fluid from an axially high-pressure region to an axially low-pressure region relative to the steam turbine diaphragm segment; and a partially obstructive diaphragm nozzle segment coupled with the at least one diaphragm nozzle segment along the inner ring and the outer ring, the partially obstructive diaphragm nozzle segment having: a pair of opposing sidewalls; an airfoil extending between the pair of opposing sidewalls and integral with each of the pair of sidewalls, the airfoil having a single contact surface for directing a flow of the working fluid from the axially high pressure region to the the axially low pressure region; and a fill region integral with the airfoil and the pair of opposing sides, the fill region extending between the pair of opposing sides along an entirety of a length of the airfoil, the fill region for completely obstructing the flow of working fluid from the axially high pressure region to the axially low pressure region.

A third aspect of the disclosure includes a steam turbine having: a rotor; a turbine casing at least partially surrounding the rotor; and a diaphragm segment between the turbine casing and the rotor, the diaphragm segment having: an outer ring; an inner ring within the outer ring; at least one diaphragm nozzle segment coupled to the inner ring and the outer ring, the at least one diaphragm nozzle segment having an airfoil and integral sidewalls for directing a flow of a working fluid from an axially high pressure region to an axially low pressure region relative to the steam turbine diaphragm segment; and a partially obstructive diaphragm nozzle segment coupled with the at least one diaphragm nozzle segment along the inner ring and the outer ring, the partially obstructive diaphragm nozzle segment having: a pair of opposing sidewalls; an airfoil extending between the pair of opposing sidewalls and integral with each of the pair of sidewalls, the airfoil having a single contact surface for directing a flow of the working fluid from the axially high pressure region to the axially low pressure region; and a fill region integral with the airfoil and the pair of opposing sides, the fill region extending between the pair of opposing sides along an entirety of a length of the airfoil, the fill region for completely obstructing the flow of working fluid from the axially high pressure region to the axially low pressure region.

BRIEF DESCRIPTION OF THE DRAWINGS

These and other features of this invention will be more readily understood from the following detailed description of the various aspects of the invention taken in conjunction with the accompanying drawings that depict various embodiments of the disclosure, in which.

Figure 1:
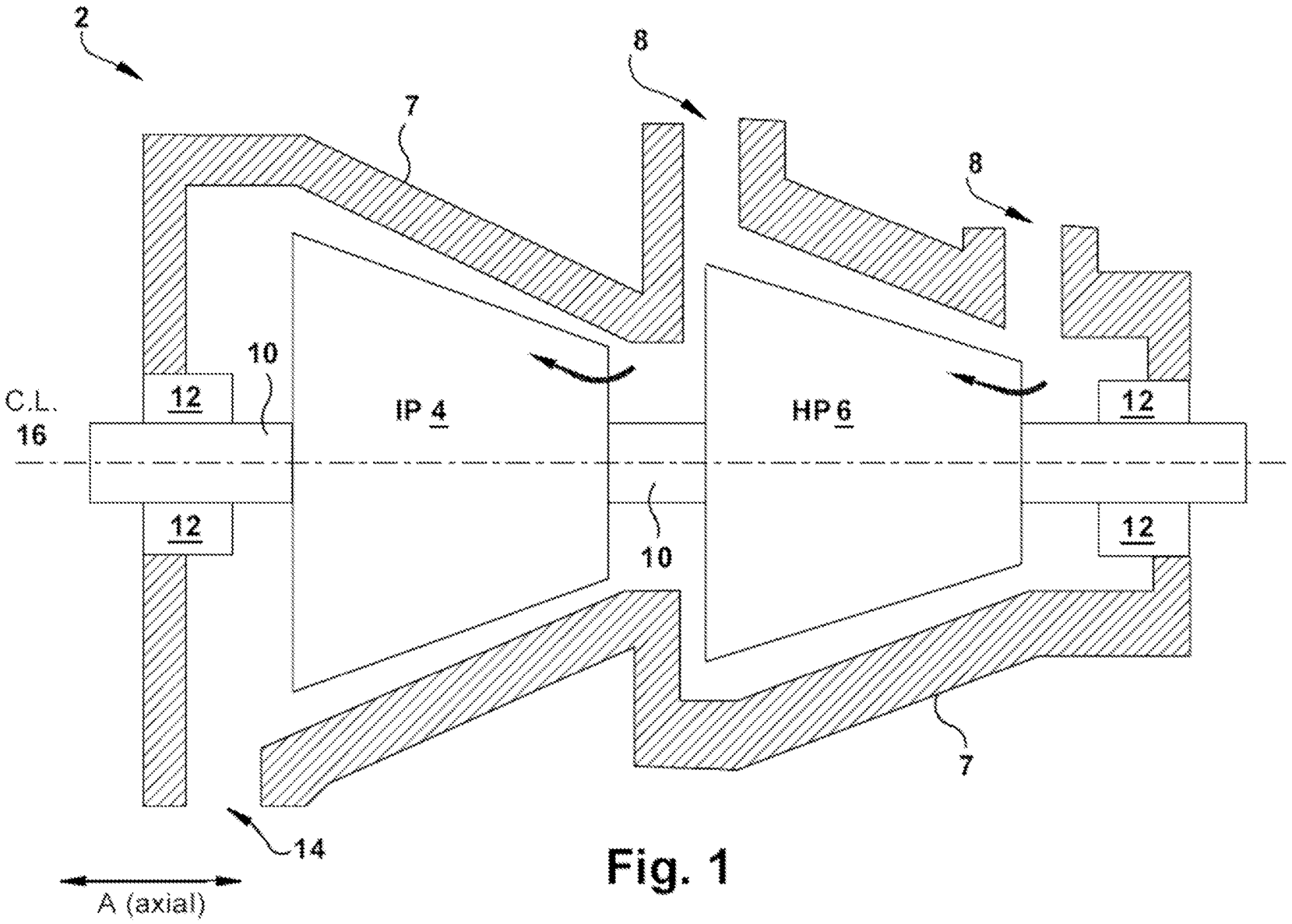
FIG. 1 shows a partial cross-sectional schematic view of steam turbine according to various embodiments.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

The subject matter disclosed herein relates to steam turbines. Specifically, the subject matter disclosed herein relates to nozzle segments in steam turbines.

According to various embodiments of the disclosure, a steam turbine nozzle segment includes an at least partially obstructive flow section in the nozzle airfoil area (flow channel) to obstruct the flow of steam through that area. In some cases, a plurality of such nozzle segments are arranged in a configuration to obstruct the flow of steam to rotating buckets. Various embodiments include a steam turbine nozzle assembly including both obstructing nozzle segments and traditional nozzle segments (which include an airfoil for directing flow of steam to the rotating buckets). According to various approaches herein, the obstructing nozzle segments can include sidewalls sized to fit integrally with traditional nozzle segments such that the traditional nozzle segments need not be modified (e.g., for retrofit or repair/replacement scenarios). Additional embodiments include an assembly having a completely obstructive nozzle segment, a partially obstructive nozzle segment connected to the completely obstructive nozzle segment, and a traditional nozzle segment (e.g., including an airfoil for directing flow of steam to rotating buckets) connected to the partially obstructive nozzle segment.

As denoted in these Figures, the "A" axis represents axial orientation (along the axis of the turbine rotor, omitted for clarity). As used herein, the terms "axial" and/or "axially" refer to the relative position/direction of objects along axis A, which is substantially parallel with the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference (c) which surrounds axis A but does not intersect the axis A at any location.

Turning to FIG. 1, a partial cross-sectional schematic view of steam turbine 2 (e.g., a high-pressure/intermediate-pressure steam turbine) is shown. Steam turbine 2 may include, for example, an intermediate pressure (IP) section 4 and a high pressure (HP) section 6. The IP section 4 and HP section 6 are at least partially encased in casing 7. Steam may enter the HP section 6 and IP section 4 via one or more inlets 8 in casing 7, and flow axially downstream from the inlet(s) 8. In some embodiments, the HP section 6 and IP section 4 are joined by a common shaft 10, which may contact bearings 12, allowing for rotation of the shaft 10, as working fluid (steam) forces rotation of the blades within each of the IP section 4 and the HP section 6. After performing mechanical work on the blades within the IP section 4 and the HP section 6, working fluid (e.g., steam) may exit through outlet 14 in casing 7. The center line (CL) 16 of the HP section 6 and IP section 4 is shown as a reference point. Both the IP section 4 and the HP section 6 can include diaphragm assemblies, which are contained within segments of casing 7.

Figure 2:
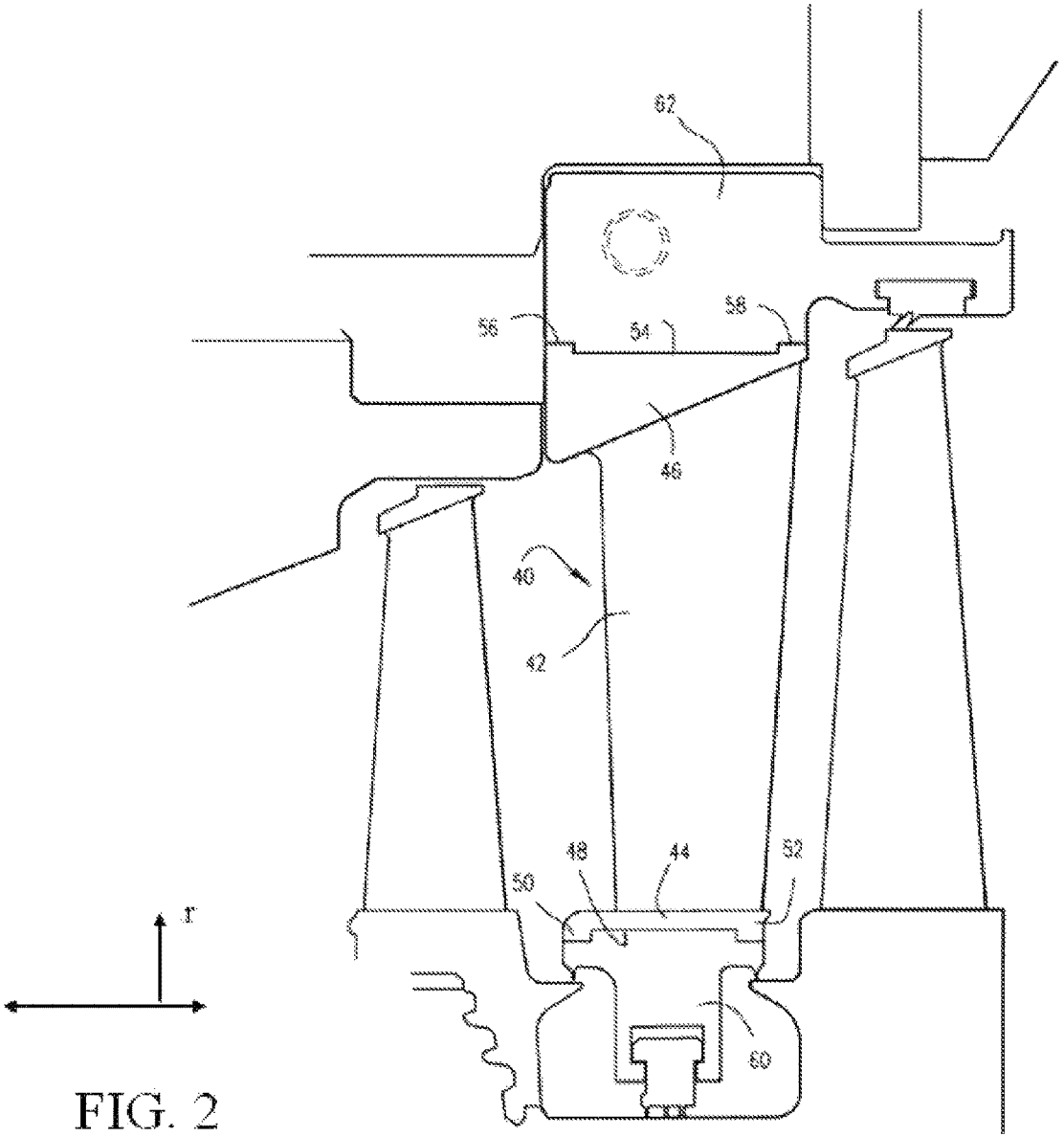
FIG. 2 shows an embodiment of a nozzle assembly which utilizes a singlet, i.e., a single airfoil with sidewalls directly welded to inner and outer rings.

FIG. 2 shows an embodiment of a nozzle assembly which utilizes a singlet, i.e., a single airfoil with sidewalls welded to inner and outer rings directly, e.g., with a low heat input weld. Particularly, the nozzle assembly in FIG. 2 includes integrally formed singlet subassemblies generally designated 40. Each subassembly 40 includes a single airfoil or blade 42 between inner and outer sidewalls 44 and 46, respectively, the blade 42 and sidewalls 44, 46 being machined from a near net forging or a block of material. As illustrated, the inner sidewall 44 includes a female recess 48 flanked or straddled by radially inwardly projecting male steps or flanges 50 and 52 along leading and trailing edges of the inner sidewall 44. Alternatively, the inner sidewall 44 may be constructed to provide a central male projection flanked by radially outwardly extending female recesses adjacent the leading and trailing edges of the inner sidewall. Similarly, the outer sidewall 46, as illustrated, includes a female recess 54 flanked or straddled by a pair of radially outwardly extending male steps or flanges 56, 58 adjacent the leading and trailing edges of the outer sidewall 46. Alternatively, the outer sidewall 46 may have a central male projection flanked by radially inwardly extending female recesses along leading and trailing edges of the outer sidewall.

The nozzle singlets 40 are then assembled between the inner and outer rings 60 and 62, respectively, using a low heat input type weld. For example, the low heat input type weld uses a butt weld interface and preferably employs an electron beam weld, laser weld, or a shallow MIG (GMAW) weld process. By using these weld processes and types of welds, the weld is limited to the area between the sidewalls and rings adjacent the steps of the sidewalls or in the region of the steps of the inner and outer rings if the configuration is reversed at the interface than shown in FIG. 2. Thus, the welding occurs for only a short axial distance, e.g., not exceeding the axial extent of the steps along opposite axial ends of the sidewalls, and without the use of filler weld material. Particularly, less than ½ of the axial distance spanning the inner and outer sidewalls is used to weld the singlet nozzle between the inner and outer rings. For example, by using electron beam welding in an axial direction from both the leading and trailing sides of the interface between the sidewalls and the rings, the axial extent of the welds where the materials of the sidewalls and rings coalesce is less than ½ of the extent of the axial interface.

Figure 3:
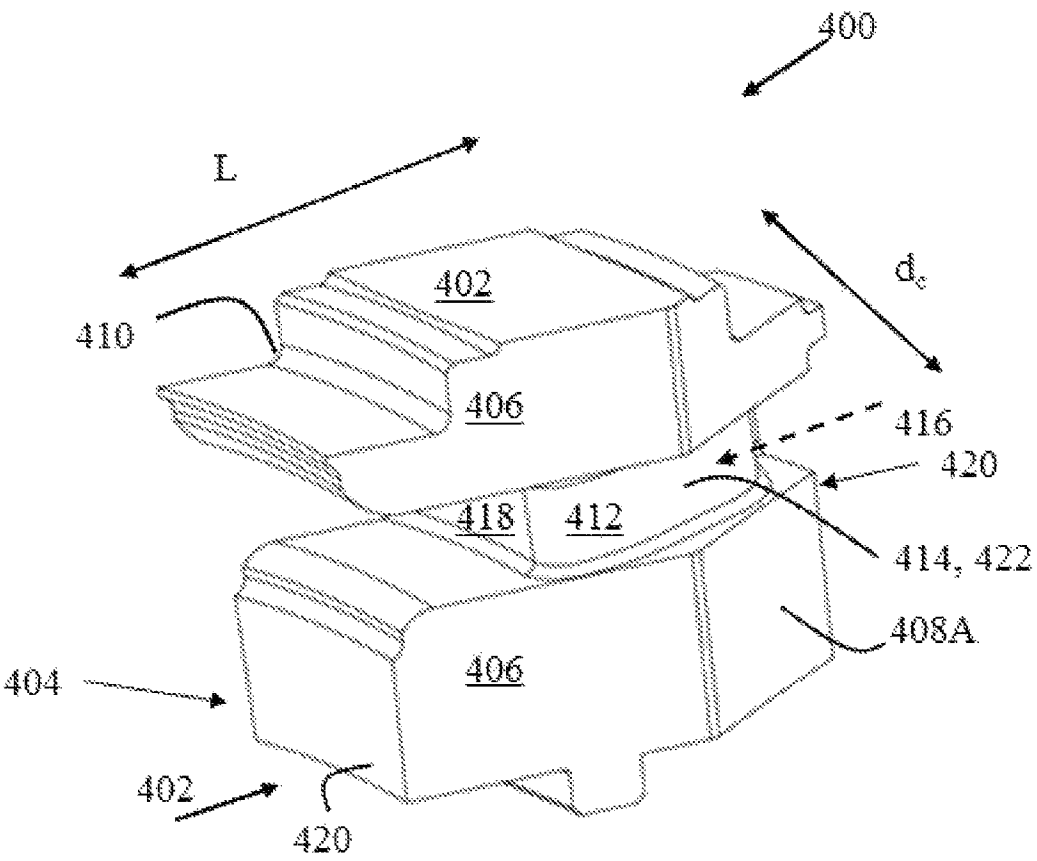
FIGS. 3 and 4 each show schematic three-dimensional perspective views of embodiments of partially obstructive steam turbine nozzle segments according to various embodiments.
Figure 4:
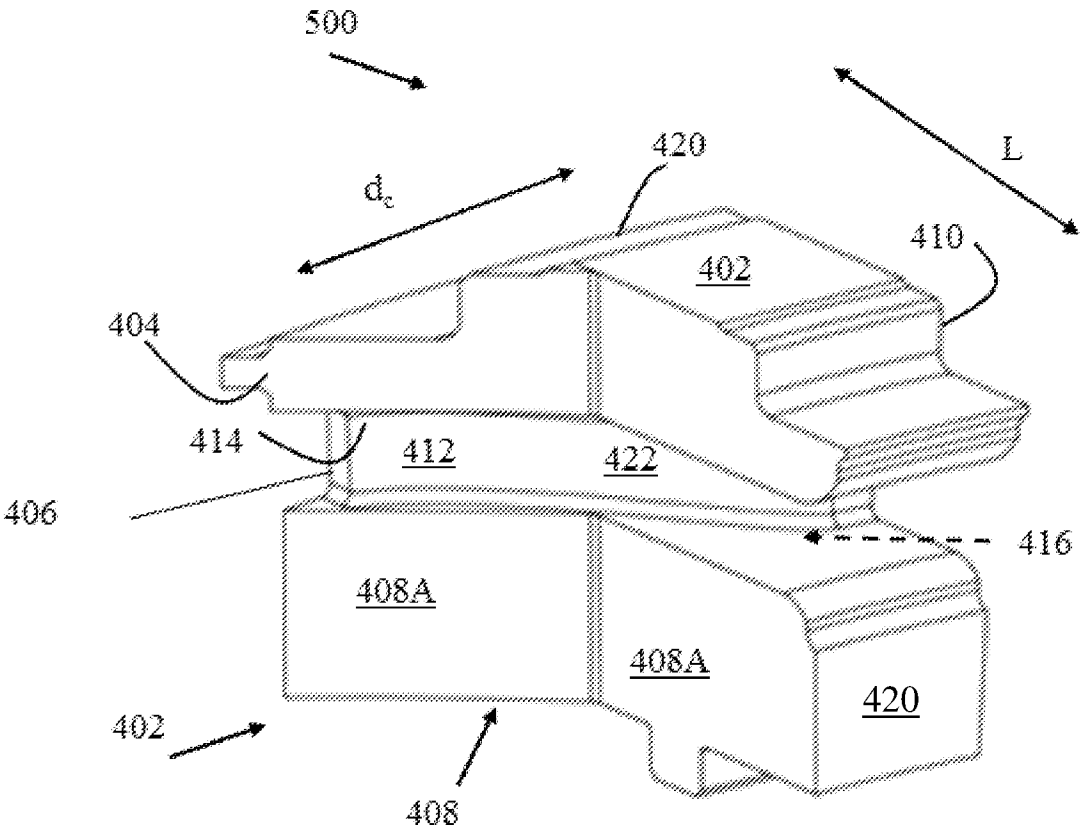

FIGS. 3 and 4 show schematic three-dimensional perspective views of embodiments of a first partially obstructive steam turbine nozzle segment (partially obstructive nozzle segment) 400, and second partially obstructive steam turbine nozzle segment (partially obstructive nozzle segment) 500, respectively. Commonly labeled elements between the figures can represent substantially similar features, and as such, redundant explanation of those features is omitted for the purposes of clarity. The partially obstructive nozzle segment 400, 500 can be configured to act as a transitional nozzle segment (partially obstructive) in a diaphragm assembly (discussed herein), such that partially obstructive nozzle segment 400, 500 can connect to a traditional nozzle segment (e.g., including an airfoil and openings on both circumferential sides of the airfoil) and to a completely obstructive nozzle segment (preventing circumferential flow of working fluid).

According to various embodiments, partially obstructive nozzle segment 400, 500 can include a pair of opposing sidewalls 402, which are configured to couple with respective inner and outer diaphragm rings 60, 62 (FIG. 2). In various embodiments, sidewalls 402 are sized to respectively engage an inner ring 60 of a steam turbine diaphragm, and an outer ring 62 of the steam turbine diaphragm (FIG. 2). In some configurations, the pair of opposing sidewalls 402 can be contoured at least on one of a leading edge 404 or a trailing edge 406 in order to mate (e.g., complement) a sidewall of an adjacent, traditional nozzle segment in a diaphragm assembly. In various embodiments, the contour 408 can include a pair of angled surfaces 408A for mating with an adjacent sidewall in a distinct steam turbine diaphragm nozzle segment. The opposing edge (e.g., leading edge 404 or trailing edge 406) of sidewalls 402 can include a substantially planar surface 410, which can be configured to mate (contact coincident) with a planar surface of the completely obstructive nozzle segment. Partially obstructive nozzle segment 400, 500 can also include an airfoil 412 extending between sidewalls 402 and integral with each sidewall 402. In various embodiments, airfoil 412 has a single contact surface 414 (e.g., pressure side of airfoil 412) for directing a flow of working fluid (e.g., steam) through a flow channel 416 (shown in phantom). Partially obstructive nozzle segment 400, 500 can also include a fill region 418 integral with airfoil 412 and sidewalls 402. Fill region 418, airfoil 412 and sidewalls 402 can be integrally cast or forged from a common (e.g., substantially homogeneous) material such as a metal (e.g., steel, iron, etc.). Fill region 418 can extend between sidewalls 402 along an entirety of a length (L) of airfoil 412, where fill region 418 is sized and positioned to completely obstruct the flow of working fluid (e.g., steam).

More particularly, sidewalls 402 each have a circumferential dimension ($d_c$) measured along opposing sides 420 of each sidewall 402, and fill region 418 extends from airfoil 412 to a first circumferential edge (leading edge 404, trailing edge 406) of each sidewall 402 along circumferential dimension ($d_c$). As described herein, airfoil 412 has a pressure side 422 defining a portion of flow channel 416, where the flow channel 416 extends from pressure side 422 to a second circumferential edge (e.g., other one of leading edge 404 or trailing edge 406) of each of sidewalls 402 along circumferential dimension ($d_c$), where the second circumferential edge (e.g., other one of leading edge 404 or trailing edge 406) is distinct from the first circumferential edge (e.g., leading edge 404 or trailing edge 406).

Figure 6:
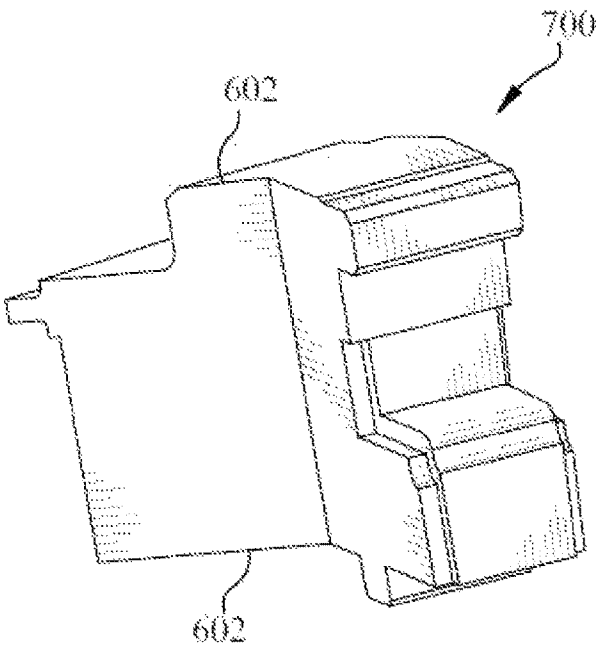
FIGS. 5 and 6 show schematic three-dimensional perspective views of embodiments of completely obstructive steam turbine nozzle segments according to various embodiments.
Figure 5:
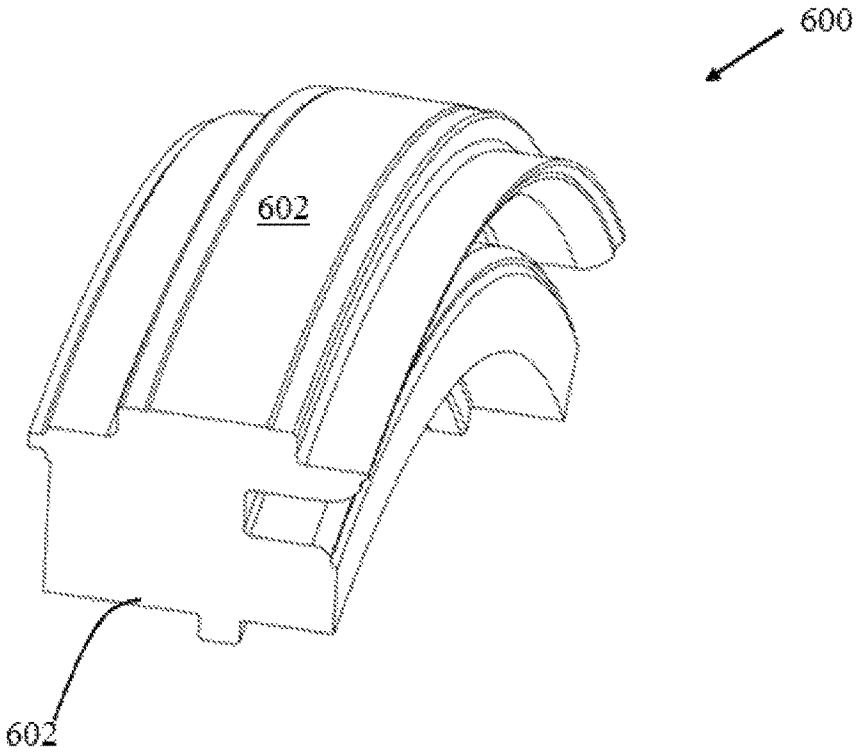
Figure 7:
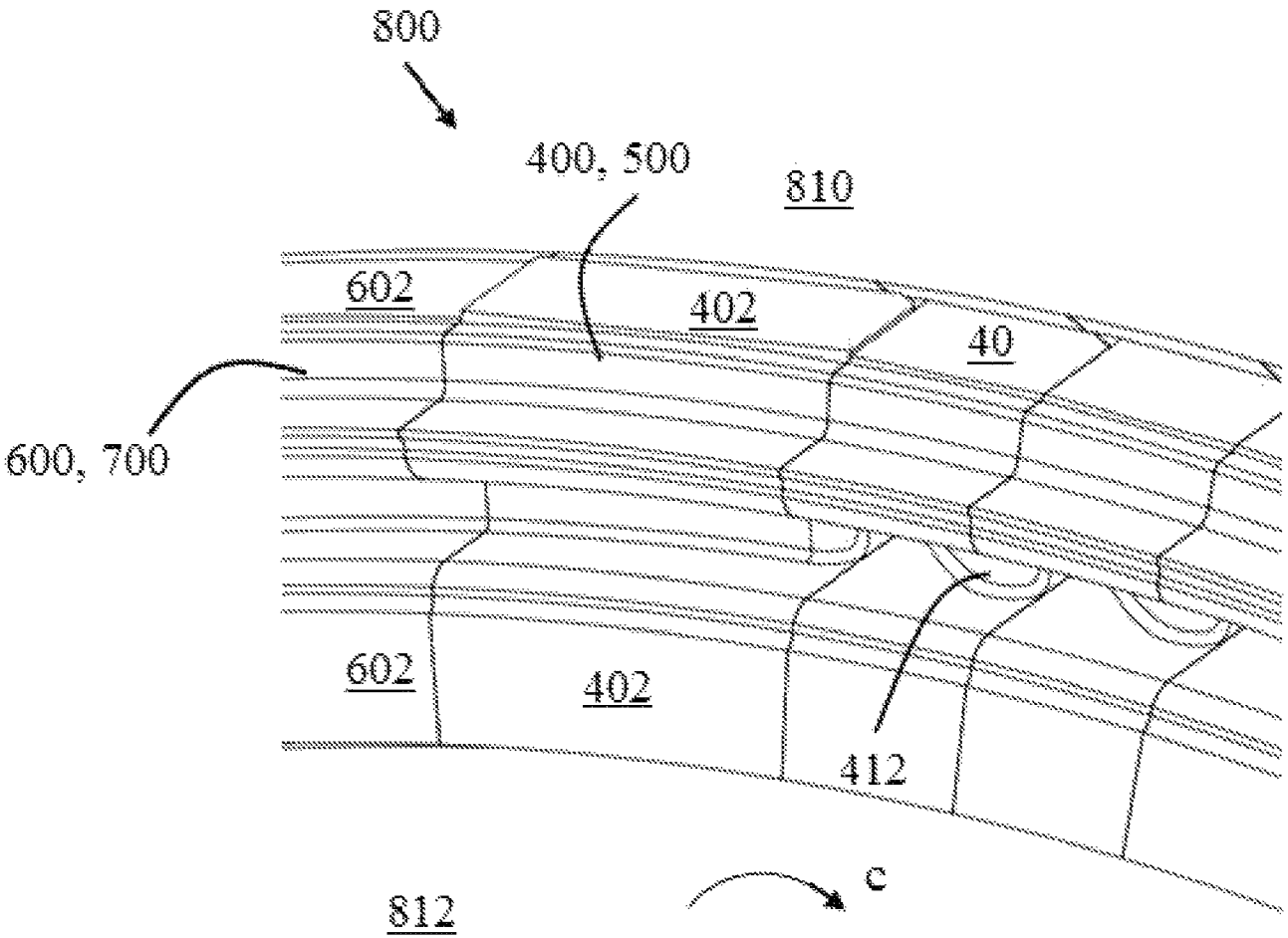
FIG. 7 shows a close-up three-dimensional perspective view of a portion of a diaphragm assembly according to various embodiments.
Figure 8:
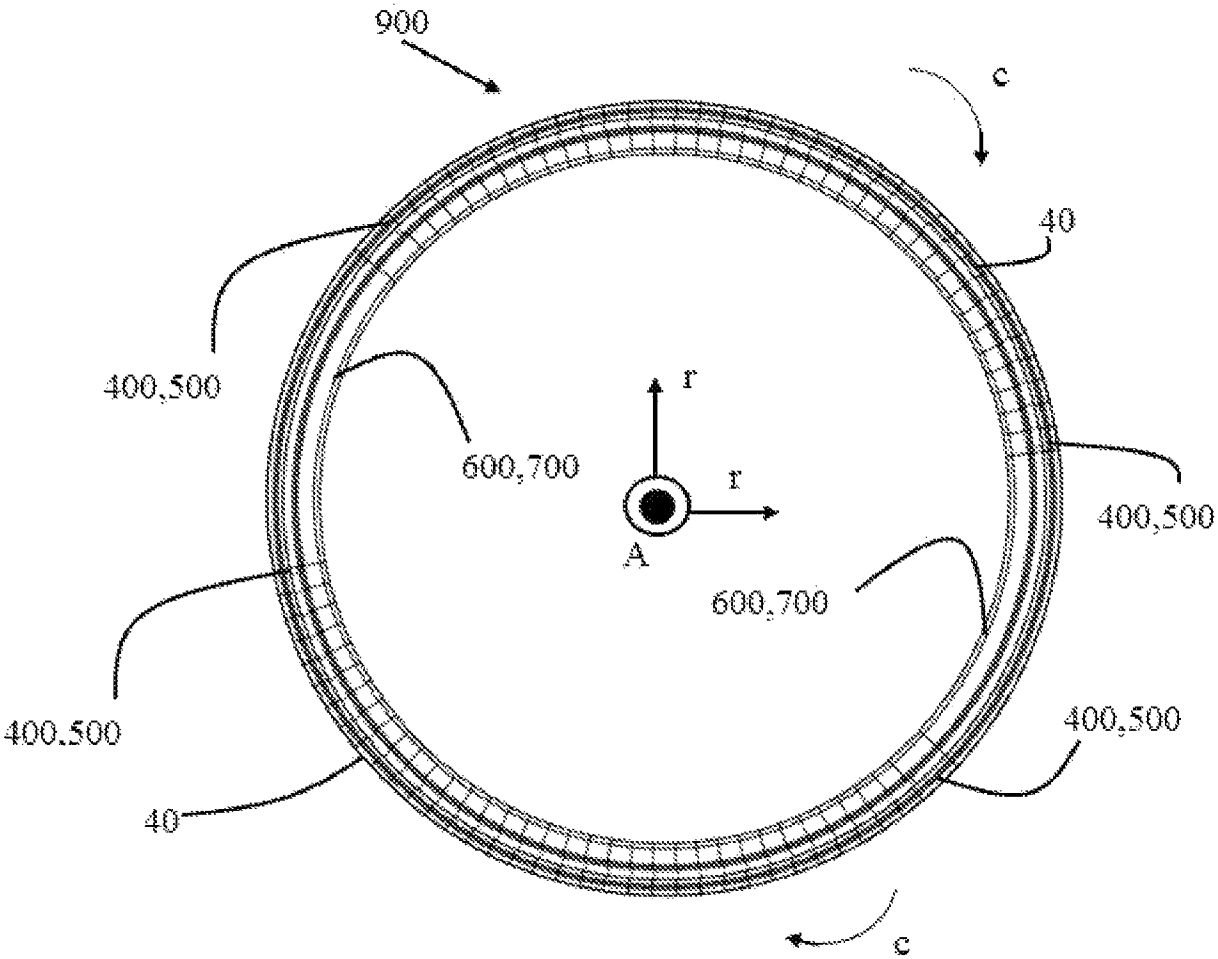
FIG. 8 shows a schematic end view of a section of a diaphragm assembly according to various embodiments.

FIGS. 5 and 6 show schematic three-dimensional perspective views of embodiments of a first completely obstructive steam turbine nozzle segment (completely obstructive nozzle segment) 600, and second steam turbine nozzle segment (completely obstructive nozzle segment) 700, respectively. Commonly labeled elements between the figures can represent substantially similar features, and as such, redundant explanation of those features is omitted for the purposes of clarity. FIG. 7 shows a close-up three-dimensional perspective view of a portion of a diaphragm assembly 800 including a completely obstructive nozzle segment 600, 700 mated with transitional nozzle segment 400, 500, which in turn is mated with a conventional angled-sidewall nozzle segment (diaphragm nozzle segment) 40 (FIG. 2). As noted herein, completely obstructive nozzle segment 600, 700 can be configured to mate with transitional nozzle segment(s) 400, 500 at one or both circumferential edges (e.g., leading or trailing edge). According to various embodiments, completely obstructive nozzle segment 600, 700 can be coupled with the partially obstructive nozzle segment 400, 500 along the inner ring 60 and the outer ring 62, respectively, of a diaphragm assembly (FIG. 2). Completely obstructive nozzle segment 600, 700 includes a pair of opposing sidewalls 602 sized to mate with the pair of opposing sidewalls 402 of partially obstructive nozzle segment 400, 500, e.g., at substantially planar surface 410. However, it is understood that in some embodiments, the partially obstructive nozzle segment 400, 500 can include angled interfaces on both trailing edge and leading edges of sidewalls 402. Assembly 800 excludes depiction of inner ring 60 and outer ring 62 to more clearly illustrate features of nozzle segments (e.g., partially obstructive nozzle segment 400, 500 and completely obstructive nozzle segment 600, 700, interacting with nozzle segment 40). FIG. 8 shows a schematic end view of a section of a diaphragm assembly 900, illustrating the integration of partially obstructive nozzle segment 400, 500 with diaphragm nozzle segments 40, and completely obstructive nozzle segment 600,700, in a complete ring.

With reference to FIGS. 7 and 8 (and continuing reference to FIGS. 2-6), as described herein, the completely obstructive nozzle segment 600, 700 completely obstructs the flow of working fluid (e.g., steam) in the axial direction (A) from an axially high pressure region 810 to an axially low pressure region 812 (pressure differential relative to nozzle segments across axial direction) along the entire circumferential length (Lc) of the pair of opposing sidewalls 420. In various embodiments, as shown in FIGS. 3, 4 and 7, airfoil 412 of partially obstructive diaphragm nozzle segment 400, 500 has pressure side 422 defining a portion of flow channel 416 between the axially high pressure region 810 and the axially low pressure region 812.

According to various embodiments, e.g., as shown in FIG. 7, completely obstructive nozzle segment 600, 700 and/or partially obstructive diaphragm nozzle segment 400, 500 can extend a circumferential distance (dc) along inner ring 60 and outer ring 62 (FIG. 2) equal to at least two adjacent diaphragm nozzle segments 40 (e.g., several shown in assembly of FIG. 7). That is, completely obstructive nozzle segment 600, 700 and/or partially obstructive diaphragm nozzle segment 400, 500 can have a circumferential length greater than two or more conventional diaphragm nozzle segments 40. A completely obstructive nozzle segment 600,700 can have the circumferential length (along axis c) of one or more (e.g., 3, 4, 5 or more) conventional diaphragm nozzle segments 40, and can be coupled at a circumferential end (e.g., leading edge or trailing edge) with a partially obstructive diaphragm nozzle segment 400, 500, which in turn is coupled to a set (e.g., 3, 4, 5 or more) adjacently aligned conventional diaphragm nozzle segments 40. Distinct configurations are depicted in FIG. 7 for the purposes of illustration of these various embodiments.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine diaphragm nozzle segment comprising:

a pair of opposing sidewalls, wherein the pair of opposing sidewalls each have a circumferential dimension measured along opposing sides of each of the sidewalls;

an airfoil extending between the pair of opposing sidewalls and integral with each of the pair of opposing sidewalls, the airfoil having a single contact surface for directing a flow of working fluid through a flow channel, wherein the airfoil has a pressure side defining a portion of the flow channel; and a fill region integral with the airfoil and the pair of opposing sides, the fill region extending between the pair of opposing sides along an entirety of a length of the airfoil, the fill region for completely obstructing the flow of working fluid, wherein the airfoil, the pair of opposing sidewalls and the fill region are integrally cast or forged components from a homogeneous material, wherein the fill region extends from the airfoil to a first circumferential edge of each of the opposing sidewalls along the circumferential dimension, wherein the flow channel extends from the pressure side of the airfoil to a second circumferential edge of each of the opposing sidewalls along the circumferential dimension, the second circumferential edge being distinct from the first circumferential edge, the steam turbine diaphragm segment further including an inner ring and an outer ring; and a completely obstructive diaphragm nozzle segment coupled with the partially obstructive diaphragm nozzle segment along the inner ring and the outer ring, the completely obstructive diaphragm nozzle segment including a pair of opposing sidewalls mating with the pair of opposing sidewalls of the partially obstructive diaphragm nozzle segment;

wherein at least one of the completely obstructive diaphragm nozzle segment or the partially obstructive diaphragm nozzle segment extends a circumferential distance along the inner ring and the outer ring equal to at least two adjacent diaphragm nozzle segments.

2. The steam turbine diaphragm nozzle segment of claim 1, wherein each of the pair of opposing sidewalls includes a pair of angled surfaces for mating with an adjacent sidewall in a distinct steam turbine diaphragm nozzle segment.

3. The steam turbine diaphragm nozzle segment of claim 1, wherein the pair of opposing sidewalls are sized to engage the inner ring of a steam turbine diaphragm segment and the outer ring of the steam turbine diaphragm segment.

4. The steam turbine diaphragm nozzle segment of claim 1, and wherein the fill region is sized and positioned to completely obstruct the flow of working fluid.

5. The steam turbine diaphragm nozzle segment of claim 4, wherein the fill region completely obstructs the flow of the working fluid outside of the flow channel.

6. The steam turbine diaphragm nozzle segment of claim 4, wherein the single contact surface is on the pressure side of the airfoil.

7. The steam turbine diaphragm segment of claim 1, wherein the fill region terminates at the first circumferential edge of each of the opposing sidewalls.

8. A steam turbine diaphragm segment comprising:

an outer ring;

an inner ring within the outer ring;

at least one diaphragm nozzle segment coupled to the inner ring and the outer ring, the at least one diaphragm nozzle segment having an airfoil and integral sidewalls for directing a flow of a working fluid from an axially high pressure region to an axially low pressure region relative to the steam turbine diaphragm segment; and a partially obstructive diaphragm nozzle segment coupled with the at least one diaphragm nozzle segment along the inner ring and the outer ring, the partially obstructive diaphragm nozzle segment having:

a pair of opposing sidewalls, wherein the pair of opposing sidewalls of the partially obstructive diaphragm nozzle segment each have a circumferential dimension measured along opposing sides of each of the sidewalls;

an airfoil extending between the pair of opposing sidewalls and integral with each of the pair of sidewalls, the airfoil having a single contact surface for directing a flow of the working fluid from the axially high pressure region to the axially low pressure region, wherein the airfoil of the partially obstructive diaphragm nozzle segment has a pressure side defining a portion of a flow channel between the axially high pressure region and the axially low pressure region; and a fill region integral with the airfoil and the pair of opposing sides, the fill region extending between the pair of opposing sides along an entirety of a length of the airfoil, the fill region for completely obstructing the flow of working fluid from the axially high pressure region to the axially low pressure region, wherein the fill region extends from the airfoil to a first circumferential edge of each of the opposing sidewalls along the circumferential dimension, wherein the fill region terminates at the first circumferential edge of each of the opposing sidewalls, and wherein the flow channel extends from the pressure side of the airfoil to a second circumferential edge of each of the opposing sidewalls along the circumferential dimension, the second circumferential edge being distinct from the first circumferential edge, the steam turbine diaphragm segment further including:

a completely obstructive diaphragm nozzle segment coupled with the partially obstructive diaphragm nozzle segment along the inner ring and the outer ring, the completely obstructive diaphragm nozzle segment including a pair of opposing sidewalls mating with the pair of opposing sidewalls of the partially obstructive diaphragm nozzle segment, wherein at least one of the completely obstructive diaphragm nozzle segment or the partially obstructive diaphragm nozzle segment extends a circumferential distance along the inner ring and the outer ring equal to at least two adjacent diaphragm nozzle segments.

9. The steam turbine diaphragm segment of claim 8, wherein the pair of opposing sidewalls of the completely obstructive diaphragm nozzle segment mate with the pair of opposing sidewalls of the partially obstructive diaphragm nozzle segment.

10. The steam turbine diaphragm segment of claim 8, wherein the completely obstructive diaphragm nozzle segment completely obstructs the flow of working fluid from the axially high pressure region to the axially low pressure region along an entire circumferential length of the pair of opposing sidewalls.

11. The steam turbine diaphragm segment of claim 8, wherein the airfoil, the pair of opposing sidewalls and the fill region of the partially obstructive diaphragm nozzle segment are integrally cast or forged components from a homogeneous material.

12. The steam turbine diaphragm segment of claim 8, wherein the fill region is integrally cast or forged with the airfoil, and wherein the fill region is sized and positioned to completely obstruct the flow of working fluid, wherein the fill region completely obstructs the flow of the working fluid outside of the flow channel, wherein the single contact surface is on the pressure side of the airfoil.

13. A steam turbine comprising:

a rotor;

a turbine casing at least partially surrounding the rotor; and a diaphragm segment between the turbine casing and the rotor, the diaphragm segment having:

an outer ring;

an inner ring within the outer ring;

at least one diaphragm nozzle segment coupled to the inner ring and the outer ring, the at least one diaphragm nozzle segment having an airfoil and integral sidewalls for directing a flow of a working fluid from an axially high pressure region to an axially low pressure region;

at least one partially obstructive diaphragm nozzle segment coupled with the at least one diaphragm nozzle segment along the inner ring and the outer ring, the partially obstructive diaphragm nozzle segment having:

a pair of opposing sidewalls, wherein the pair of opposing sidewalls of the partially obstructive diaphragm nozzle segment each have a circumferential dimension measured along opposing sides of each of the sidewalls;

an airfoil extending between the pair of opposing sidewalls and integral with each of the pair of sidewalls, the airfoil having a single contact surface for directing a flow of the working fluid from the axially high pressure region to the axially low pressure region, wherein the airfoil of the partially obstructive diaphragm nozzle segment has a pressure side defining a portion of a flow channel between the axially high pressure region to the axially low pressure region; and a fill region integral with the airfoil and the pair of opposing sides, the fill region extending between the pair of opposing sides along an entirety of a length of the airfoil, the fill region for completely obstructing the flow of working fluid from the axially high pressure region to the axially low pressure region, wherein the fill region extends from the airfoil to a first circumferential edge of each of the opposing sidewalls along the circumferential dimension, wherein the flow channel extends from the pressure side of the airfoil to a second circumferential edge of each of the opposing sidewalls along the circumferential dimension, the second circumferential edge being distinct from the first circumferential edge; and at least one completely obstructive diaphragm nozzle segment coupled with the partially obstructive diaphragm nozzle segment along the inner ring and the outer ring, the completely obstructive diaphragm nozzle segment including a pair of opposing sidewalls mating with the pair of opposing sidewalls of the partially obstructive diaphragm nozzle segment, wherein the completely obstructive diaphragm nozzle segment completely obstructs the flow of working fluid from the axially high pressure region to the axially low pressure region along an entire circumferential length of the pair of opposing sidewalls; and wherein at least one of the completely obstructive diaphragm nozzle segment or the partially obstructive diaphragm nozzle segment extends a circumferential distance along the inner ring and the outer ring equal to at least two adjacent diaphragm nozzle segments.

14. The steam turbine of claim 13, wherein the pair of opposing sidewalls of the completely obstructive diaphragm nozzle segment mate with the pair of opposing sidewalls of the partially obstructive diaphragm nozzle segment.

15. The steam turbine of claim 13, wherein the fill region is integrally cast or forged with the airfoil, and wherein the fill region is sized and positioned to completely obstruct the flow of working fluid, wherein the fill region completely obstructs the flow of the working fluid outside of the flow channel, wherein the single contact surface is on the pressure side of the airfoil.

* * * * *